US007589692B2

(12) United States Patent
Kim et al.

(10) Patent No.: US 7,589,692 B2
(45) Date of Patent: Sep. 15, 2009

(54) PLANAR INVERTED F ANTENNA TAPERED TYPE PIFA WITH CORRUGATION

(75) Inventors: Byung-Chan Kim, Daejon (KR); Je-Hoon Yun, Daejon (KR); Hyung-Do Choi, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 155 days.

(21) Appl. No.: 10/575,347

(22) PCT Filed: Oct. 15, 2004

(86) PCT No.: PCT/KR2004/002654

§ 371 (c)(1),
(2), (4) Date: Apr. 11, 2006

(87) PCT Pub. No.: WO2005/038984

PCT Pub. Date: Apr. 28, 2005

(65) Prior Publication Data

US 2007/0132640 A1 Jun. 14, 2007

(30) Foreign Application Priority Data

Oct. 16, 2003 (KR) ..... 10-2003-0072082

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/24*** | (2006.01) |
| ***H01Q 13/10*** | (2006.01) |

(52) U.S. Cl. ..... 343/846; 343/700 MS; 343/770; 343/702

(58) Field of Classification Search ..... 343/702, 343/700 MS, 770, 846

See application file for complete search history.

(56) References Cited

U.S. PATENT DOCUMENTS 5,883,603 A 3/1999 Kim (Continued)

FOREIGN PATENT DOCUMENTS

JP 2003-092510 3/2003

(Continued)

OTHER PUBLICATIONS

Kathleen L. Virga; "Low-Profile Enhanced-Bandwidth PIFA Antennas for Wireless Communications Packaging"; IEEE Transactions on Microwave Theory and Techniques, vol. 45, No. 10; Oct. 1997; pp. 1879-1888.

(Continued)

*Primary Examiner*—Douglas W Owens
*Assistant Examiner*—Jennifer F Hu
(74) *Attorney, Agent, or Firm*—Lowe Hauptman Ham & Berner, LLP

(57) ABSTRACT

A planar inverted F antenna having a radiation patch having an asymmetric shape of linearly-tapered rectangle with a plurality of corrugated hollows is disclosed. The planar inverted F antenna having a radiation patch, includes: a first radiation patch for radiating a signal; a ground plate for grounding the first radiation patch; a feeding line for supplying an electric power to the first radiation patch; a short plate having one side coupled to the first radiation patch and other side coupled to the ground plate for shorting the first radiation patch, wherein the first radiation patch having an asymmetrical shape of linearly tapered rectangle and has one or more corrugated hollows.

13 Claims, 2 Drawing Sheets

U.S. PATENT DOCUMENTS

| | | | | |
|---|---|---|---|---|
| 6,181,281 | B1 * | 1/2001 | Desclos et al. | 343/700 MS |
| 6,573,867 | B1 * | 6/2003 | Desclos et al. | 343/700 MS |
| 6,667,716 | B2 | 12/2003 | Chen | |
| 6,717,548 | B2 | 4/2004 | Chen | |
| 7,345,631 | B2 * | 3/2008 | Kim et al. | 343/700 MS |
| 2001/0050635 | A1 | 12/2001 | Weinberger | |
| 2003/0038749 | A1 * | 2/2003 | Chen | 343/700 MS |
| 2003/0038750 | A1 * | 2/2003 | Chen | 343/700 MS |
| 2004/0075611 | A1 * | 4/2004 | Kenoun et al. | 343/702 |
| 2005/0275595 | A1 * | 12/2005 | Endo et al. | 343/702 |
| 2006/0244668 | A1 * | 11/2006 | Iellici et al. | 343/729 |
| 2008/0106470 | A1 * | 5/2008 | Hu et al. | 343/700 MS |

FOREIGN PATENT DOCUMENTS

| | | |
|---|---|---|
| KR | 1020030017128 | 3/2003 |
| KR | 1020040019487 | 3/2004 |

OTHER PUBLICATIONS

Shackelford et al.; "Design of Small-Size Wide-Bandwidth Microstrip-Patch Antennas"; IEEE Antennas and Propagation Magazine, vol. 45, No. 1; Feb. 2003; pp. 75-83.

International Search Report dated Jan. 26, 2005 for PCT/KR2004/002654.

* cited by examiner

[Fig. 3]
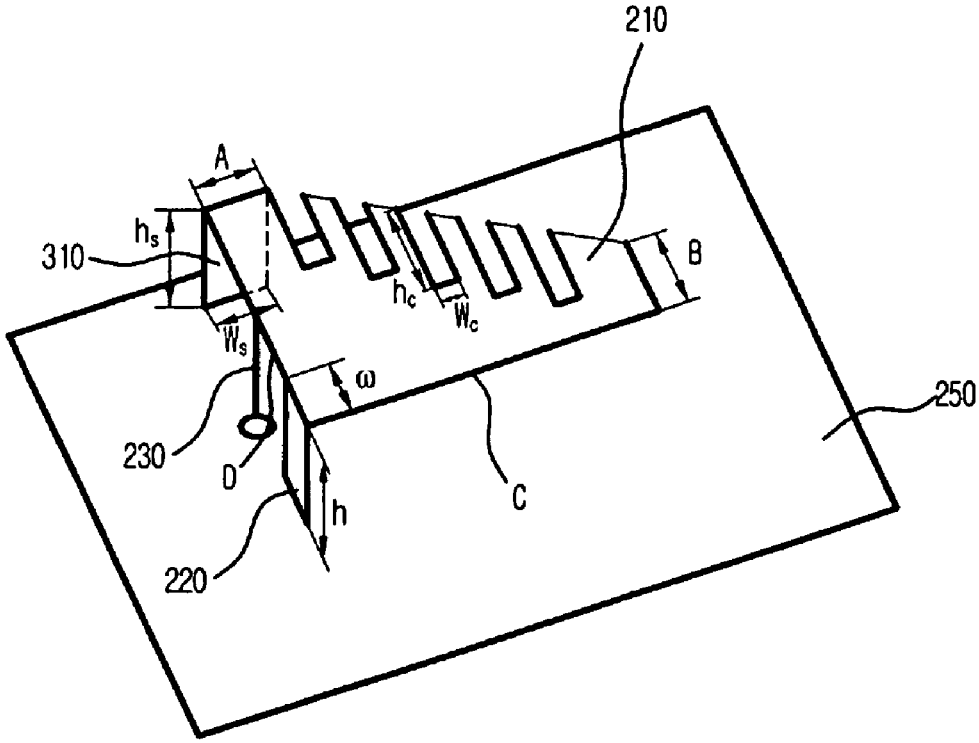

PLANAR INVERTED F ANTENNA TAPERED TYPE PIFA WITH CORRUGATION

CROSS REFERENCE TO RELATED APPLICATION

This application is the National Phase application of International Application No. PCT/KR2004/002654, filed Oct. 15, 2004, which designates the United States and was published in English. This application, in its entirety, is incorporated herein by reference.

FIELD OF THE INVENTION

The present invention relates to a radiation patch for a planar inverted F antenna; and, more particularly, to the radiation patch having an asymmetric shape of linearly-tapered rectangle with a plurality of corrugated hollows for a planar inverted F antenna in order to provide wide bandwidth characteristic.

DESCRIPTION OF RELATED ARTS

A planar inverted F antenna is a modified microstrip antenna having a shape of inverted F.

FIG. 1 is a diagram illustrating a conventional planar inverted F antenna in accordance with a prior art.

Referring to FIG. 1, the conventional planar inverted F antenna 100 includes a rectangular radiation patch 110 having a size of a length $L_P$ and width $W_P$, a shorting plate 120, a feeding line 130 and a ground plane 140.

The shorting plate 120 is attached between the ground plane 140 and the rectangular radiation patch 110. The feeding line 130 supplies electric power to the rectangular radiation patch 110.

The planar inverted F antenna has been widely used in a wireless communication field since its advantages such as simple structure, low profile, easy to manufacture and low cost.

However, the conventional planar inverted F antenna has a size of ¼ of a wavelength, which is smaller than a general size of conventional microstrip antenna, which is ½ of a wavelength, but the conventional planar inverted F antenna is still large to be implemented into a mobile terminal. Accordingly, there has been demanded a technology reducing the size of the conventional planar inverted F antenna Furthermore, a technology maintaining or widening a bandwidth of the conventional planar inverted F antenna has also been demanded since the bandwidth of the conventional planar inverted F antenna is also reduced in correspondence to the size of the conventional planar inverted F antenna.

For overcoming the above mentioned drawback, Terry Kinchun Lo and Yeongming Whang disclose a technology for widening a bandwidth by punching various shapes of slots such as shapes of L or U and uses various feeding methods. The bandwidth is widened according to a length and a width of the slots. However, it is getting more complicated for designing the conventional planar inverted F antenna.

Furthermore, Kathleen L. Virga and Yahya Rahmat-Smaii disclose another technology for widening a bandwidth in "Low Profile Enhanced-Bandwidth PIFA antenna for Wireless Communication Packaging", IEEE TRANSACTION ON MICROWAVE THEORY AND TECHNIQUES, vol. 45, No. 10, pp 1879-1888, October, 1997. For widening the frequency bandwidth, Kathleen and Yahya implement additional patches to an antenna or two patches connected by timing diode as a radiation device. As a result, a frequency bandwidth is getting wider, e.g., 14% of bandwidth is increased than the linear antenna or dipole antenna. However, the antenna introduced by Kathleen and Yahya is complicated and a manufacturing cost is increased.

SUMMARY OF THE INVENTION

It is, therefore, an object of the present invention to provide a planar inverted F antenna for widening a frequency bandwidth by providing a linearly tapered rectangular shape of radiation patch and forming a predetermined number of corrugated hollows having a predetermined length and width on the radiation patch.

It is another object of the present invention to provide a planar inverted F antenna for widening a frequency bandwidth and obtaining flexibility of antenna design by providing a radiation patch having an asymmetric shape of linearly tapered rectangular having a plurality of corrugated hollows.

In accordance with another aspect of the present invention, there is provided a planar inverted F antenna having a radiation patch, including: a first radiation patch for radiating a signal; a ground plate for grounding the first radiation patch; a feeding line for supplying an electric power to the first radiation patch; a short plate having one side coupled to the first radiation patch and other side coupled to the ground plate for shorting the first radiation patch, wherein the first radiation patch having an asymmetrical shape of linearly tapered rectangle and has one or more corrugated hollows.

BRIEF DESCRIPTION OF THE DRAWINGS

The above and other objects and features of the present invention will become better understood with regard to the following description of the preferred embodiments given in conjunction with the accompanying drawings, in which:

FIG. 3 is a diagram showing a planar inverted F antenna in accordance with another preferred embodiment of the present invention.

DETAILED DESCRIPTION OF THE INVENTION

Hereinafter, a planar inverted F antenna in accordance with a preferred embodiment of the present invention will be described in more detail with reference to the accompanying drawings.

Figure 1:
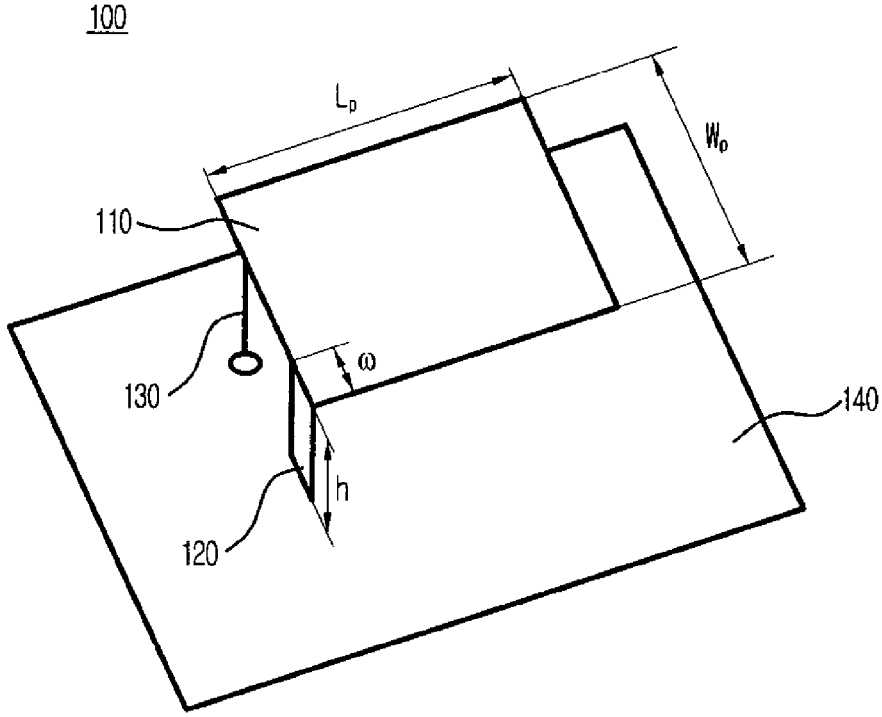
FIG. 1 (PRIOR ART)
FIG. 1 is a diagram illustrating a conventional planar inverted F antenna in accordance with a prior art.
Figure 2:
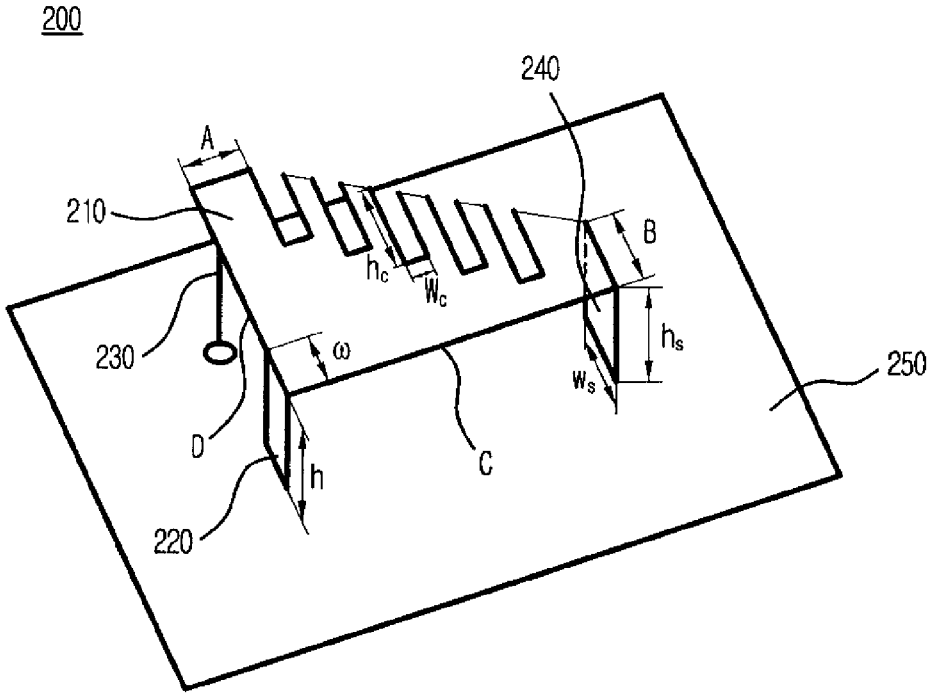
FIG. 2 is a diagram illustrating a planar inverted F antenna in accordance with a preferred embodiment of the present invention.

FIG. 2 is a diagram illustrating a planar inverted F antenna in accordance with a preferred embodiment of the present invention.

As shown in FIG. 2, the planar inverted F antenna 200 includes a radiation patch 210, an additional radiation patch 240, a shorting plate 220, a feeding line 230 and a ground plate 250.

The shorting plate 220 is equipped in between the ground plate 250 and the radiation patch 210. One side of the shorting plate 220 is coupled to the radiation patch 210 and other side of the shorting plate 220 is coupled to the ground plate 250. The shorting plate 220 has a function to short the radiation patch 210.

The feeding line 230 connected to the radiation patch 210 through the ground plate 250 has a function to supply electric power to the radiation patch 210.

The radiation patch 210 of the present invention is an asymmetrical shape of linearly tapered rectangle having a plurality of corrugated hollows along with a tapered line and each of the corrugated hollows has a predetermined length $h_c$ and a predetermined width $w_c$. By providing the asymmetrical shape of linearly tapered rectangle having a plurality of corrugated hollows, a frequency bandwidth of the antenna is widened.

Generally, various paths of electric current must be included on the radiation patch for widening the frequency bandwidth of the antenna. That is, various frequencies of electric current must be resonated on the radiation patch. In the present invention, the radiation patch 210, which is the asymmetrical shape of linearly tapered rectangle, induces various paths of electric current comparing to a square shape of a conventional antenna. Accordingly, the frequency bandwidth of the antenna is widened.

In the present invention, a length of A or B of the radiation patch 210 are determined according to desired resonant frequency. Also, a ratio of taper in the radiation patch 210 is determined according to the desired resonant frequency.

Furthermore, a plurality of the corrugated hollows makes a length of current path following along the radiation patch 210 longer. That is, it makes electrical length of the radiation patch longer.

The number of the corrugated hollows formed on the radiation patch 210, the length $h_c$ and the width $w_c$ are determined according to the desired resonant frequency. Furthermore, a plurality of the corrugated hollows have different length $h_c$ and the width $w_c$.

The additional radiation patch 240 extends the electrical length of the radiation patch 210. The additional radiation patch 240 is coupled at one side of the radiation patch 210 which is opposite end having the shorting plate 220. A length h.sub.s of the additional radiation patch 240 must be shorter than the length h of the shorting plate 220. Also, the length h.sub.s and a width w.sub.s of the additional radiation patch 240 are determined according to the desired resonant frequency.

The shorting plate 220 has a predetermined length h and width ω for adjusting the desired resonant frequency and the shorting plate 220 can be coupled either of a length side C and a width side D of the radiation patch 210.

The feeding line 230 can be arranged any side of the radiation patch 210. In the preferred embodiment of the present invention in FIG. 2, the feeding line 230 is directly coupled to the radiation patch 210 which is a probe method of feeding line and however, it can be coupled to the radiation patch according to a coupling method.

FIG. 3 is a diagram showing a planar inverted F antenna in accordance with another embodiment of the present invention.

As shown in FIG. 3, the planar inverted F antenna 300 has a structure identical to the planar inverted F antenna 200 in FIG. 2 excepting a location of an additional radiation patch 310. The additional radiation patch 310 is coupled to a length side A of the radiation patch 210 having an asymmetric shape of linearly tapered rectangular having a plurality of corrugated hollows. Since the other structure of the planar inverted F antenna 300 is the same as the planar inverted F antenna 200 in FIG. 2, detailed descriptions of the planar inverted F antenna 300 are omitted.

As mentioned above, the present invention can widen the frequency bandwidth of the planar inverted F antenna by shaping a radiation patch having an asymmetric shape of a linearly tapered rectangle and forming a plurality of corrugated hollows on the radiation patch.

Also, the present invention can provide longer electrical length compared to similar size of conventional antenna by a planar inverted F antenna having a linearly tapered rectangle shape of radiation patch having a plurality of corrugated hollows and additional radiation patch.

Furthermore, the present invention can be implemented in various application fields by providing a linearly tapered rectangle shape of radiation patch having a plurality of corrugated hollows in a planar inverted F antenna.

The present invention contains subject matter related to Korean patent application No. KR 2003-0072082, filed in the Korean patent office on Oct. 16, 2003, the entire contents of which being incorporated herein by reference.

While the present invention has been described with respect to certain preferred embodiments, it will be apparent to those skilled in the art that various changes and modifications may be made without departing from the spirit and scope of the invention as defined in the following claims.

What is claimed is:

1. A planar inverted F antenna having a radiation patch, comprising:

a first radiation patch for radiating a signal, comprising:

a first edge;

a second edge parallel to the first edge and having a length smaller than a length of the first edge;

a third edge adjacent to the first edge and connecting the first edge and the second edge at a first point and a second point, respectively;

a fourth edge adjacent to the first edge and parallel to the third edge, said fourth edge connecting the first edge at a third point, and a linearly tapered corrugated fifth edge connecting the fourth edge and the second edge at fourth and fifth points, respectively, wherein said fourth point is located away from the third point and on the fourth edge and said fifth point being located away from the second point on the second edge;

a ground plate for grounding the first radiation patch;

a feeding line for supplying an electric power to the first radiation patch;

a shorting plate having a length disposed between the first radiation patch and the ground plate;

a second radiation patch coupled to at least one of the edges of the first radiation patch and disposed between the first radiation patch and the ground plate, wherein said first radiation patch is disposed in a plane parallel to the ground plate;

wherein said fifth edge comprises a plurality of corrugated hollows each extending from a straight line connecting said fourth and fifth points toward said third edge.

2. The planar inverted F antenna of claim 1, wherein first and second widths along which said shorting plate is coupled to the first edge of the first radiation patch and the ground plate, respectively, said second width being located opposite to the first width.

3. The planar inverted F antenna of claim 2, wherein the second radiation patch is coupled to the second edge of the first radiation patch.

4. The planar inverted F antenna of claim 3, wherein the length of the shorting plate is greater than a length of the second radiation patch between the first radiation patch and the ground plate.

5. The planar inverted F antenna of claim 2, wherein the second radiation patch is coupled to the fourth edge of the first radiation patch.

6. The planar inverted F antenna of claim 5, wherein the length of the shorting plate is greater than a length of the second radiation patch between the first radiation patch and the ground plate.

7. The planar inverted F antenna of claim 6, wherein the feeding line is directly coupled to the first edge of the first radiation patch between the shorting plate and the second radiation patch.

8. The planar inverted F antenna of claim 1, wherein a length and a width of the second radiation patch are determined according to a desired resonant frequency.

9. The planar inverted F antenna of claim 1, wherein a ratio of taper in the first radiation patch, the number of corrugated hollows defined in the linearly tapered corrugated edge, a length and a width of each of the corrugated hollows are determined according to the desired resonant frequency.

10. The planar inverted F antenna of claim 1, wherein each of the corrugated hollows includes two opposite side edges parallel to the first edge, and a bottom edge parallel to the third edge.

11. The planar inverted F antenna of claim 10, wherein distances between the third edge and the bottom edges of the corrugated hollows increase from the second edge toward the first edge.

12. The planar inverted F antenna of claim 11, wherein the shorting plate is directly coupled to and between the first edge of the first radiation patch and the ground plate;

the length of the shorting plate is greater than a length of the second radiation patch between the first radiation patch and the ground plate;

the second radiation patch is directly coupled to the second edge of the first radiation patch; and the feeding line is directly coupled to the first edge of the first radiation patch between the shorting plate and the fourth edge.

13. The planar inverted F antenna of claim 11, wherein the shorting plate is directly coupled to and between the first edge of the first radiation patch and the ground plate;

the length of the shorting plate is greater than a length of the second radiation patch between the first radiation patch and the ground plate;

the second radiation patch is directly coupled to the fourth edge of the first radiation patch; and the feeding line is directly coupled to the first edge of the first radiation patch between the shorting plate and the second radiation patch.

* * * * *